US006717086B2

(12) United States Patent
Sawyer et al.

(10) Patent No.: US 6,717,086 B2
(45) Date of Patent: Apr. 6, 2004

(54) SWITCH WITH ADJUSTABLE BIASING MEANS

(75) Inventors: Anthony M. Sawyer, Broadstone (GB); Paul R. J. Marshallsay, Lymington (GB)

(73) Assignee: Advanced Input Devices UK Limited, Ringwood (GB)

( * ) Notice: Subject to any disclaimer, the term of this patent is extended or adjusted under 35 U.S.C. 154(b) by 0 days.

(21) Appl. No.: 09/957,479

(22) Filed: Sep. 19, 2001

(65) Prior Publication Data

US 2002/0096426 A1 Jul. 25, 2002

(30) Foreign Application Priority Data

Sep. 21, 2000 (GB) ..... 0023206

(51) Int. Cl.[7] ..... H01H 13/52
(52) U.S. Cl. ..... 200/526; 200/302.2; 200/527
(58) Field of Search ..... 200/520, 521, 200/3, 41, 526, 528, 333, 336, 345, 566; 345/156

(56) References Cited

U.S. PATENT DOCUMENTS 5,087,803 A * 2/1992 Kurtz ..... 200/526

FOREIGN PATENT DOCUMENTS

GB 2 339 632 2/2000

* cited by examiner

*Primary Examiner*—Lincoln Donovan
*Assistant Examiner*—M. Fishman
(74) *Attorney, Agent, or Firm*—Thomas Schneck; Gina McCarthy

(57) ABSTRACT

A switch (1) comprising an outer housing (3) and an inner component (5); switch means (13) operable to provide a signal upon depression of said outer housing (3) resilient biasing means (29) located between the inner component and the outer housing to provide a force which bias the outer housing from the inner component; and means (9, 17) for varying the spacing between the inner component and the outer housing and hence the biasing force provided by said resilient biasing means.

16 Claims, 2 Drawing Sheets

SWITCH WITH ADJUSTABLE BIASING MEANS

FIELD OF THE INVENTION

This invention relates to switches, and more particularly—but not exclusively—to switches for use in computer systems.

BACKGROUND OF THE INVENTION

Over the last few decades, the use of computers has become widespread in business, education and at home. Modern computers are typically controllable by way of graphical user interfaces (GUIs) which allow a user to control the computer simply by manipulating a cursor to select commands from lists of alternatives displayed in pull-down menus on the screen of the computer.

The cursors employed in GUIs are designed to be controlled by a pointing device rather than a keyboard, although in practice control is often duplicated on the keyboard so that the computer can still be controlled if the pointing device should fail. Various pointing devices have been developed for control of a cursor in a GUI environment. The pointing devices are also typically provided with one or more switches or buttons for user selection of system functions. Separate switching modules may also be provided.

All of these previously proposed pointing devices may easily be manipulated by an able-bodied user to control a cursor in a GUI, and thus to control a computer. These modem computers can be controlled to perform a large number of functions such as speech replication and global communication through the internet and through modem to modem connections.

Given the great utility of modem computers, it would be highly desirable if they could be effectively utilised by mentally and physically disabled persons to perform a variety of different functions. To this end, various pointing devices have been developed which cater for the special needs of disabled users. These devices provide improved mechanisms for the control of an on-screen cursor, but they typically do not address the problems associated with the user selection of computer system functions.

For example, some mental and physical disabilities are such that the disabled person is incapable of illustrating the fine motor control necessary to depress keys of a keyboard or to depress buttons on a conventional pointing device to select functions of, or perform tasks on, a computer system. Other disabled persons suffer from problems associated with hand shake, for example, that cause a repeated depression of a button when they only wanted to press the button once. As a consequence of this, these disabled persons can be unable to effectively operate modern GUI-driven computers.

A means for alleviating these problems has previously been proposed in United Kingdom Patent Publication No. 2,339,632. This document describes an actuator for a switch which enables the resilient bias against which the actuator is movable to be adjusted to account for variations in the motor ability of different users.

Whilst the arrangement proposed in this document does alleviate the above mentioned problems, it has been noted that the actuator disclosed is rather large and can therefore take up a significant amount of desktop space. This is generally not too much of a problem when the switch is used at home or work on a desktop (when space considerations are not usually paramount), but can be a problem when used with a laptop computer in a mobile computing environment, for example, where space considerations are more important.

One might suppose that a solution to this new problem simply would be to reduce the size of the actuator disclosed in the above mentioned patent application.

However, such an approach would not be appropriate since by reducing the size of the actuator one would also severely limit the range and degree to which the resilient bias can be varied. The principle reason for this is that the preferred embodiment disclosed in this application includes a resiliently flexible beam which rides upon a pair of supports that can be moved with respect to one another to vary the distance between them, and hence vary the resistance to flexing of the beam. If one were to shorten the beam (as would be required if the actuator were to be reduced in size), then the degree to which the spacing between the supports could be varied would be reduced, and hence the range of resilient bias provided by the actuator would be correspondingly reduced.

A further problem is concerned with the fact that the preferred embodiment of the above mentioned actuator has a spiral track in which cams move, and reducing the size of the track could cause problems with the track becoming blocked by dirt or other foreign bodies.

A yet further problem is that reducing the size of the track would require a corresponding reduction in the size of the cams. If the cams were to made of the same material (as would be preferred to keep the cost of the device acceptably low), then there is a danger that they would no longer be sufficiently strong (after having been reduced in size) to survive the normal day to day stresses imposed upon the device during use.

It is apparent, therefore, that a new construction which avoids these problems would be advantageous. Accordingly, it is an object of the present invention to provide a switch which avoids and/or alleviates these problems.

SUMMARY OF THE INVENTION

In accordance with an aspect of the invention, there is provided a switch comprising an outer housing and an inner component; switch means operable to provide a signal upon depression of said outer housing; resilient biasing means located between the inner component and the outer housing to provide a force which biases the outer housing from the inner component; and means for varying the spacing between the inner component and the outer housing and hence the biasing force provided by said resilient biasing means.

This aspect of the invention alleviates the problems mentioned above by providing a relatively compact switch that allows the initial spacing of the outer housing and inner component to be varied to vary the biasing force provided by the resilient biasing means. This means that for those users who lack sufficient strength to effectively utilise conventional switches, the resistive force (i.e. the biasing force) can be decreased so that a lesser pressure is required. Similarly, for those persons who suffer from hand shake, for example, the resistive force (i.e. the bias force) can be increased so that a definite depressive movement is required to activate the switch and so that relatively small hand movements, that could be cased by a hand tremor for example, do not cause the switch to be activated.

Furthermore, by adopting a this arrangement in preference to the arrangement disclosed in the above mentioned patent application it is possible to provide a switch which is significantly smaller and more compact than the previously proposed switch.

Preferably, the switch comprises a base having an inner retaining member upstanding therefrom.

Preferably, the inner component is mounted on and movable with respect to the inner retaining member.

Preferably, the inner component has a threaded inner surface which is screw-threadedly engageable with a threaded outer surface portion of the inner retaining member.

Preferably, the spacing varying means comprises the threaded inner surface of the inner component and the threaded outer surface of said inner retaining member.

Preferably, rotation of the outer housing causes the biasing force provided by said resilient biasing means to vary.

Preferably, the inner component rotates with the outer housing.

Preferably, the inner component comprises a plurality of laterally extending (preferably laterally outwardly extending) tabs or lugs locatable in respective longitudinal grooves formed in an inside lateral surface of said outer housing.

Preferably, the grooves permit longitudinal movement of the tabs or lugs to allow depression of the outer housing to cause operation of the switch means.

Preferably, the base has an outer retaining member upstanding therefrom, the outer retaining member having a transversely extending flange against which a transversely extending flange of the outer housing can abut to resist decoupling of the outer housing from the base.

Preferably, the resilient biasing means comprises a spring.

Preferably, the switch is substantially circular.

Preferably, variation in the spacing of the outer housing and inner component is accomplished whilst maintaining a substantially constant spacing between the outer housing and the base.

In accordance with a further embodiment of the invention, there is provided a switch for a computer system, the switch comprising: a base; a retaining member upstanding from the base, an inner component rotatably and screw-threadedly engaged with the retaining member; an outer housing connected for rotational movement with the inner component; resilient biasing means provided between the outer housing and inner component to bias one from the other; and switch means operable to provide a signal upon depression of said outer housing; the arrangement being such that rotation of the outer housing causes the spacing between the inner component and the outer housing and hence the biasing force provided by said resilient biasing means to vary.

A further aspect of the invention relates to use of a switch as described herein as an item selection tool for a computer system.

A preferred embodiment of the invention will now be described by way of example only with reference to the accompanying drawings, in which:

DETAILED DESCRIPTION OF THE INVENTION

Figure 1:
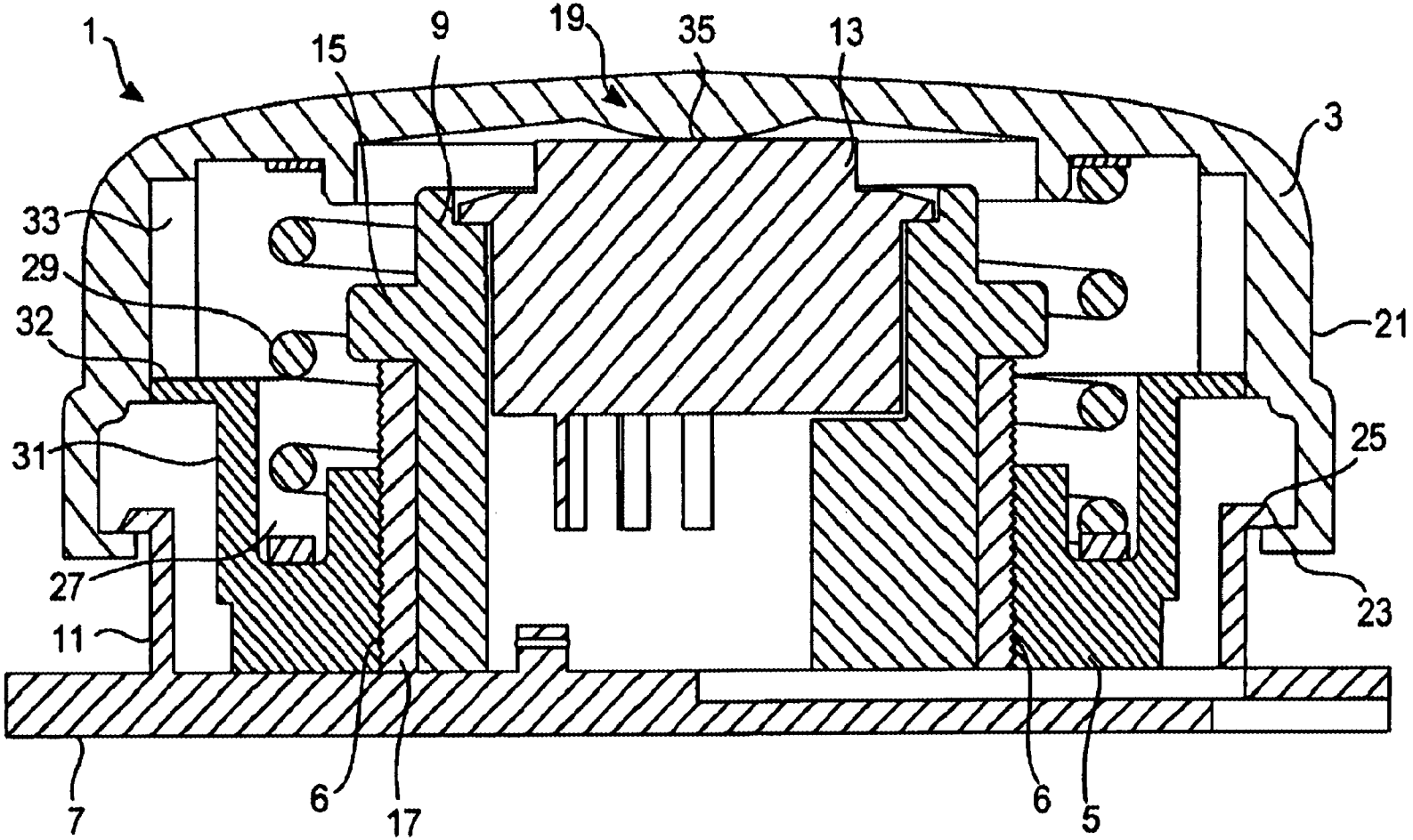
FIG. 1 is a cross-sectional view through a switch in its initial state.

As shown in FIG. 1, the switch 1 of this embodiment comprises an outer housing 3, an inner component 5, and a base 7. Although not apparent from the figures, the switch 1—in plan view—is generally circular.

Upstanding from the base 7 are an inner retaining member 9, and an outer retaining member 11. The inner retaining member 9 comprises, as shown, a cylindrical structure which is provided with an internal cavity within which a switch device 13 is provided. The switch device of this embodiment comprises a proprietary electrical switch, but it will be appreciated by persons skilled in the art that a large variety of different types of switches could instead be provided.

The inner retaining member 9 is provided with a circumferential transversely projecting flange 15 which serves, in use, to limit movement of the internal component 5. An exterior portion 17, provided at the base of the inner retaining member 9, is threaded and engages with a complementary screw thread formed on an inner surface of the internal component 5.

The outer housing 3 comprises a cap portion 19 and a lateral side portion 21. The outer housing 3 is retained on the base 7 by means of a lateral projecting flange 23 which abuts with a corresponding transverse flange 25 provided on the outer retaining member 11.

The internal component 5 is provided with a channel 27 within which one end of a resilient biasing means 29 is located. The other end of the resilient biasing means abuts against, and may be located in a groove formed in the inner surface of the outer housing 3 in the region of the cap portion 19. The resilient biasing means 29 in this preferred embodiment comprises a spring. An outer arm 31 of the inner component 5 is provided at discrete locations around the periphery of the substantially tubular inner component 5 with transversely projecting lugs 32 which engage in corresponding longitudinal grooves 33 provided on the interior of the outer housing lateral wall 21. The grooves allow movement of the lugs in a longitudinal direction, but cause abutment of the lugs and the grooves upon rotation of the outer housing 3.

As will be appreciated from the above, upon rotation of the inner component 5 the thread on the inner wall 6 thereof rides in the thread provided on the lower portion 17 of the inner retaining component 9, and causes the inner component 5 to move either towards or away from the cap portion 19 of the outer housing 3 in dependence upon whether the outer housing 3 is rotated in a clockwise or anti-clockwise direction.

It is important to note that upon rotation of the outer housing 3, the spacing between the outer housing 3 and the base 7 does not change to any substantial extent whereas the distance between the housing 3 and the inner component 5 does change.

Rotation of the inner component 5 (caused by rotation of the outer housing 3) and the associated movement towards or away from the cap portion 19 of the outer housing 3 will cause the degree to which the resilient biasing means 29 is compressed to be varied, and hence the biasing force applied by the resilient biasing means 29 to the outer housing 3 to change.

Rotation of the inner component 5 is accomplished by rotating the outer housing 3 whereupon the inside edges of the grooves 33 formed on the inside wall of the outer housing lateral wall 21 bear upon and drive the transverse lugs 32 of the inner component 5.

Figure 2:
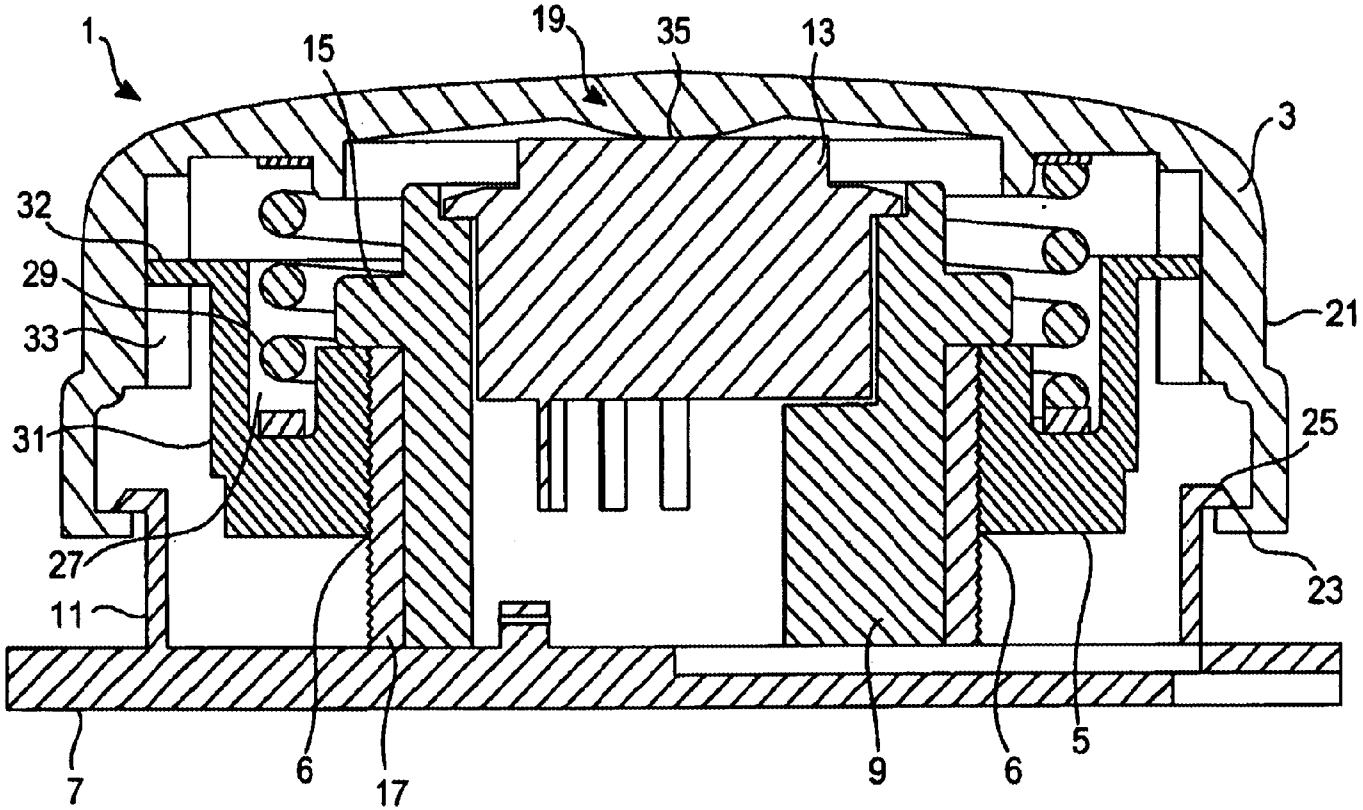
FIG. 2 is a cross-section view through the switch of FIG. 1 after the switch has been adjusted to increase the biasing force.

As mentioned above, the switch shown in FIG. 1 is in a position where the biasing force biasing the outer housing 3 away from the inner component 5 is at a minimum. FIG. 2 shows an arrangement wherein the resilient biasing means 29 has been compressed to increase the biasing force biasing the outer housing 3 away from the inner component 5. The transition from the state shown in FIG. 1 to the state shown in FIG. 2 is accomplished by rotating, as described above, the outer housing 3 in a direction which causes the inner component 5 to move towards the outer housing 3.

In whichever state the switch is in, movement of the outer housing towards the base 7 causes the transverse lugs 32 of the inner component to slide within the grooves 33 and the resilient biasing means 29 to be compressed until a projection 35 on the inside of the cap portion 19 of the outer housing 1 abuts upon and causes the switch means 13 to operate.

It is apparent, from the above, that the arrangement described herein is significantly more compact than that described in United Kingdom patent publication No. 2,339,632, and further that the arrangement described herein exhibits all of the advantages associated with the aforementioned patent publication with regard to the ability to adjust the biasing force to account for variations in the motor control skills of the user. It will be understood that the invention has been described herein by way of example only and that modifications may be made within the scope thereof.

In addition, whilst the above described switch employs a proprietary electrical switch that is directly acted upon by the interior of the cap, it will be appreciated that alternative arrangements are feasible. For example, the switch could be an optical switch, with the interior of the cap having a blanking plate mounted thereon that is moveable to make or break a beam of light to an appropriate detector. As another example, the interior of the cap could be provided with a magnet and the switch could be a leaf switch which is made or broken as the magnet is brought into close proximity to the switch. As a further alternative, the cap could indirectly act upon the switch by one of a number of different means.

What is claimed is:

1. A switch comprising: a depressible outer housing and an inner component; resilient biasing means located in a space defined by and disposed between the inner component and the outer housing to provide a force which biases the outer housing from the inner component: means for varying said space between the inner component and the outer housing so as to vary the biasing force provided by said resilient biasing means; and switch means operable to provide a signal upon depression of said outer housing towards said inner component against said biasing force.

2. The switch according to claim 1, comprising a base having an inner retaining member upstanding therefrom.

3. The switch according to claim 2, wherein the inner component is mounted on and movable with respect to the inner retaining member.

4. The switch according to claim 2, wherein the inner component has a threaded inner surface which is screw-threadedly engageable with a threaded outer surface portion of the inner retaining member.

5. The switch according to claim 4, wherein the spacing varying means comprises the threaded inner surface of the inner component and the threaded outer surface of said inner retaining member.

6. The switch according to claim 1, wherein rotation of the outer housing causes the biasing force provided by said resilient biasing means to vary.

7. The switch according to claim 6, wherein the inner component rotates with the outer housing.

8. The switch according to claim 6, wherein the inner component comprises a plurality of laterally extending tabs or lugs locatable in respective longitudinal grooves formed in an inside lateral surface of said outer housing.

9. The switch according to claim 8, wherein the grooves permit longitudinal movement of the tabs or lugs to allow depression of the outer housing to cause operation of the switch means.

10. The switch according to claim 3, wherein the base has an outer retaining member upstanding therefrom, the outer retaining member having a transversely extending flange against which a transversely extending flange of the outer housing can abut to resist decoupling of the outer housing from the base.

11. The switch according to claim 1, wherein the resilient biasing means comprises a spring.

12. The switch according to claim 1, wherein the switch is substantially circular.

13. The switch according to claim 3, wherein variation in the spacing of the outer housing and inner component is accomplished whilst maintaining a substantially constant spacing between the outer housing and the base.

14. Use of the switch according to claim 1 connected as an item selection tool for a computer system.

15. A switch for a computer system, the switch comprising:

a base;

a retaining member upstanding from the base;

an inner component rotatably and screw-threadedly engaged with the retaining member;

a depressible outer housing connected for rotational movement with the inner component;

resilient biasing means provided in a space defined by and disposed between the outer housing and inner component to bias one from the other; and switch means operable to provide a signal upon depression of said outer housing;

the arrangement being such that rotation of the outer housing causes the spacing between the inner component and the outer housing and hence the biasing force provided by said resilient biasing means to vary.

16. The switch according to claim 8, wherein the plurality of laterally extending tabs or lugs are outwardly extending.

* * * * *